US006314588B1

(12) United States Patent
Fang

(10) Patent No.: US 6,314,588 B1
(45) Date of Patent: Nov. 13, 2001

(54) RING BAND ADJUSTMENT STRUCTURE OF CRASH HELMET

(76) Inventor: Kuo-Yun Fang, 8F, No. 306, Sec. 6, Min Chuan E. Rd., Neihu District, Taipei (TW)

( * ) Notice: Subject to any disclaimer, the term of this patent is extended or adjusted under 35 U.S.C. 154(b) by 0 days.

(21) Appl. No.: 09/838,247

(22) Filed: Apr. 20, 2001

(30) Foreign Application Priority Data

Jan. 3, 2001 (TW) ..... 90200099 U

(51) Int. Cl.[7] ..... A42B 1/22
(52) U.S. Cl. ..... 2/418; 2/183
(58) Field of Search ..... 2/417, 418, 419, 2/420, 183, DIG. 11; 24/68 B, 274 WB

(56) References Cited

U.S. PATENT DOCUMENTS 2,205,741 * 6/1940 Bowers .
2,205,742 * 6/1940 Bowers .
2,926,406 * 3/1960 Edwards et al. .
3,214,809 * 11/1965 Edwards .
3,325,824 * 6/1967 Donegan .

* cited by examiner

*Primary Examiner*—Rodney M. Lindsey
(74) *Attorney, Agent, or Firm*—Rosenberg, Klein & Lee

(57) ABSTRACT

A ring band adjustment structure of a crash helmet comprises a ring band, a connection sheet, a guide element, an adjuster, a fixing element, and a locating element. The ring band has a long groove at each end portion thereof. A dentation is formed above the long groove of one end portion, and a dentation is formed below the long groove of the other end portion. The two end portions are inserted into two end faces of the connection seat. The guide element is inserted from a back face of the connection seat to penetrate the two long grooves. The fixing element passes a through hole in the guide element to join the adjuster. The adjuster drives the guide element to turn so that the two inserted end portions of ring band can move toward or away from each other.

4 Claims, 7 Drawing Sheets

RING BAND ADJUSTMENT STRUCTURE OF CRASH HELMET

FIELD OF THE INVENTION

The present invention relates to a ring band adjustment structure of a crash helmet and, more particularly, to a structure, whereby the ring band can be adjusted once to accomplish the operation of locating by turning.

BACKGROUND OF THE INVENTION

It is necessary to wear a crash helmet when riding a bicycle or a motorcycle. A ring band is provided in the crash helmet to be located and matched at the brow of a user. If the ring band is not an adjustable structure, it cannot apply to people having different sizes of heads. Several kinds of ring band adjustment structures have been proposed to let ring bands be adjustable.

As shown in FIG. 1, a fixing seat 1 and a cover sheet 2 are provided in a ring band adjustment structure. A pair of adjusters 4 are connected to two end portions of a ring band 3. The fixing seat 1 is a bar-shaped box with two openings 11 and 12 on two side faces thereof to be inserted by two end portions 31 and 32 of the ring band 3, respectively. The end portion 31 of the ring band 3 uses a pair of locating holes 33 to lock a pair of locating posts 41 of one of the adjusters 4. The other end portion 32 of the ring band 3 also uses a pair of locating holes 34 to lock a pair of locating posts 41 of the other adjuster 4. The pair of adjusters 4 respectively have guide posts 42, which protrude into guide grooves 21 and 22 at two sides of the cover sheet 2 covering an opening of the outer surface of the fixing scat 1. An insertion post 44 on an inner face of a joining sheet 43 of the guide post 42 is inserted into a post hole of the guide post 42 for locating.

Each of the adjusters 4 has a slide groove 47 to be extended into by a slide bar 46. The slide bar 46 at each side penetrates into a bottom cavity 13 or 14 of the fixing seat 1. A fixing tooth block 49 of an upper end portion of the slide bar 46 joins a rack 15 or 16 of an inner face of the fixing seat 1. The slide bar 46 has a spring 48 at an inner end portion thereof to contact a bottom face of the slide groove 47. A small shielding sheet 45 is provided outside the slide groove 47. Each of the adjusters 4 has a groove 40 on a back face thereof to be penetrated through by the rack 15 or 16. The cover sheet 2 has a central hole 23 so that a screw 24 can penetrate therethrough to join a screw hole of a central post 17 of the fixing seat 1, thereby completing the whole assembly action.

Although the above prior art has the cover sheet to accommodate the whole adjustment structure, because the fixing seat needs to be fixedly joined with the cover sheet, a joining structure must be provided between them. Because they have the same length and width, some material will be wasted, thus increasing the cost. Moreover, two ends of the ring band are locked at locating posts of an adjustment seat in the connection seat via through holes. The fixing effect of this kind of joining is not good so that other processing procedures must be matched, e.g., riveting the connection posts at the ring band. Therefore, the production cost is increased, and the manufacturing and assembling time is also increased. Additionally, the locating of the prior art adjuster can only be controlled by sense, resulting in inconvenient use. Furthermore, the adjuster has a large number of components, resulting in inconvenience in manufacturing and assembling. The present invention aims to resolve the above problems in the prior art.

SUMMARY OF THE INVENTION

An object of the present invention is to provide a ring band adjustment structure of a crash helmet, which has less components, can be adjusted for locating more easily, and can match the head of a user more tightly. By turning only once, two end portions of the ring band can be moved toward or away from each other. Moreover, economy and exactness in use can be achieved. Because of decreased number of components, use is more convenient, the whole cost is reduced, and the assembly action is faster. In other words, the present invention is more economical than the prior art structure in terms of material cost and assembly cost. Furthermore, a fairly convenient control and adjustment mechanism is provided in the present invention so that the ring band can be driven by turning to accomplish the operation of adjustment, resulting in more convenient use for the user.

To achieve the above object, the present invention comprises a ring band, a connection seat, a guide element, an adjuster, a fixing element, and a locating element. The ring band has a long groove disposed at each end portion thereof. A dentation is formed above the long groove of one end portion, and a dentation is formed below the long groove of the other end portion. The two end portions of the ring band arc inserted into two end faces of the connection seat. The guide element is inserted from a back face of the connection seat to penetrate through the pair of long grooves. A tooth portion of the guide element joins the dentations of the two long grooves. The fixing element passes a through hole in the guide element to join the adjuster so that the adjuster can rive the guide element to turn. A locating sheet is sandwiched between the adjuster and the guide element for locating so that the adjuster can only turn a tooth once.

The various objects and advantages of the present invention will be more readily understood from the following detailed description when read in conjunction with the appended drawing, in which:

DETAILED DESCRIPTION OF THE PREFERRED EMBODIMENTS

Figure 1:
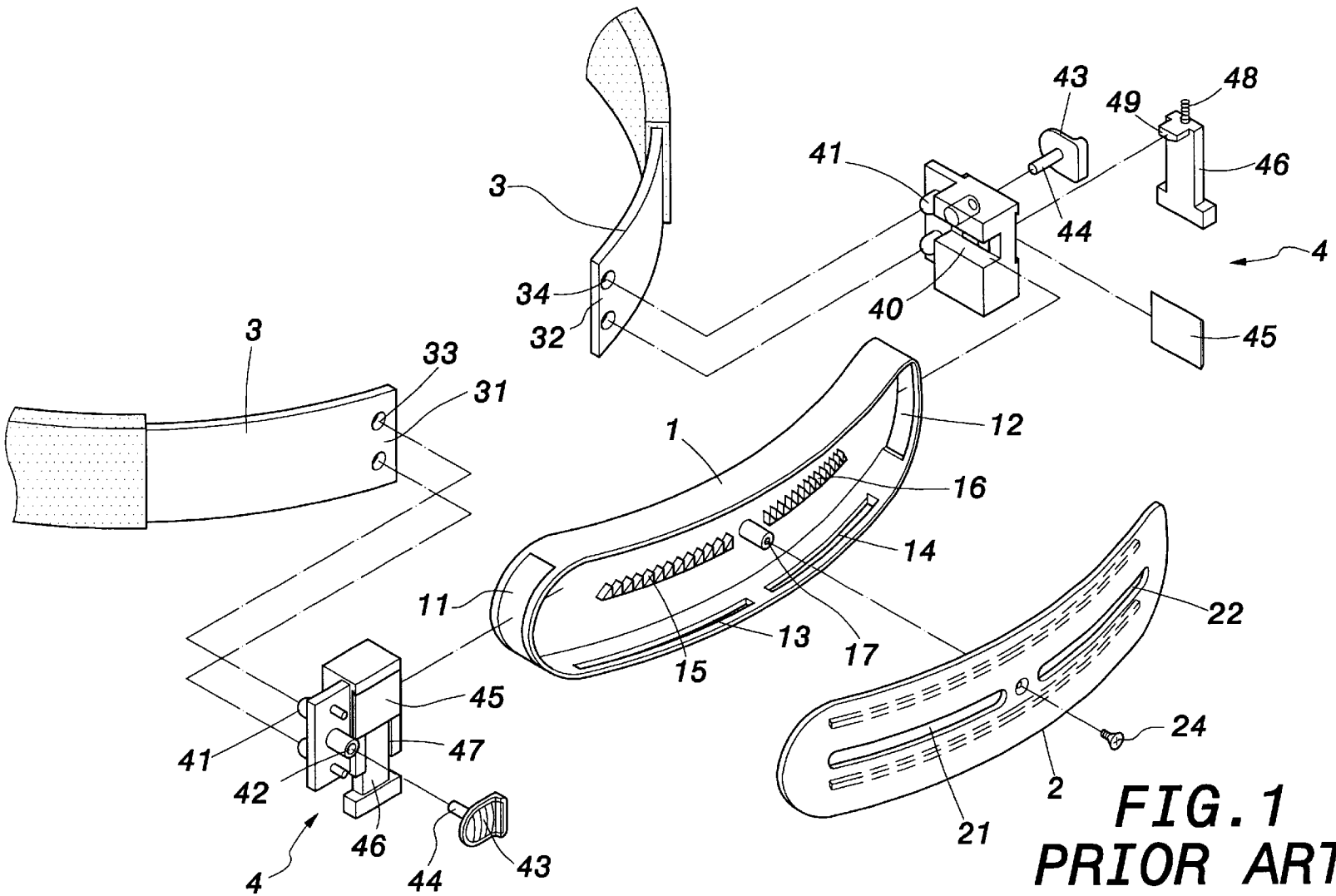
FIG. 1 PRIOR ART
FIG. 1 is an exploded perspective view of a prior art.
Figure 2:
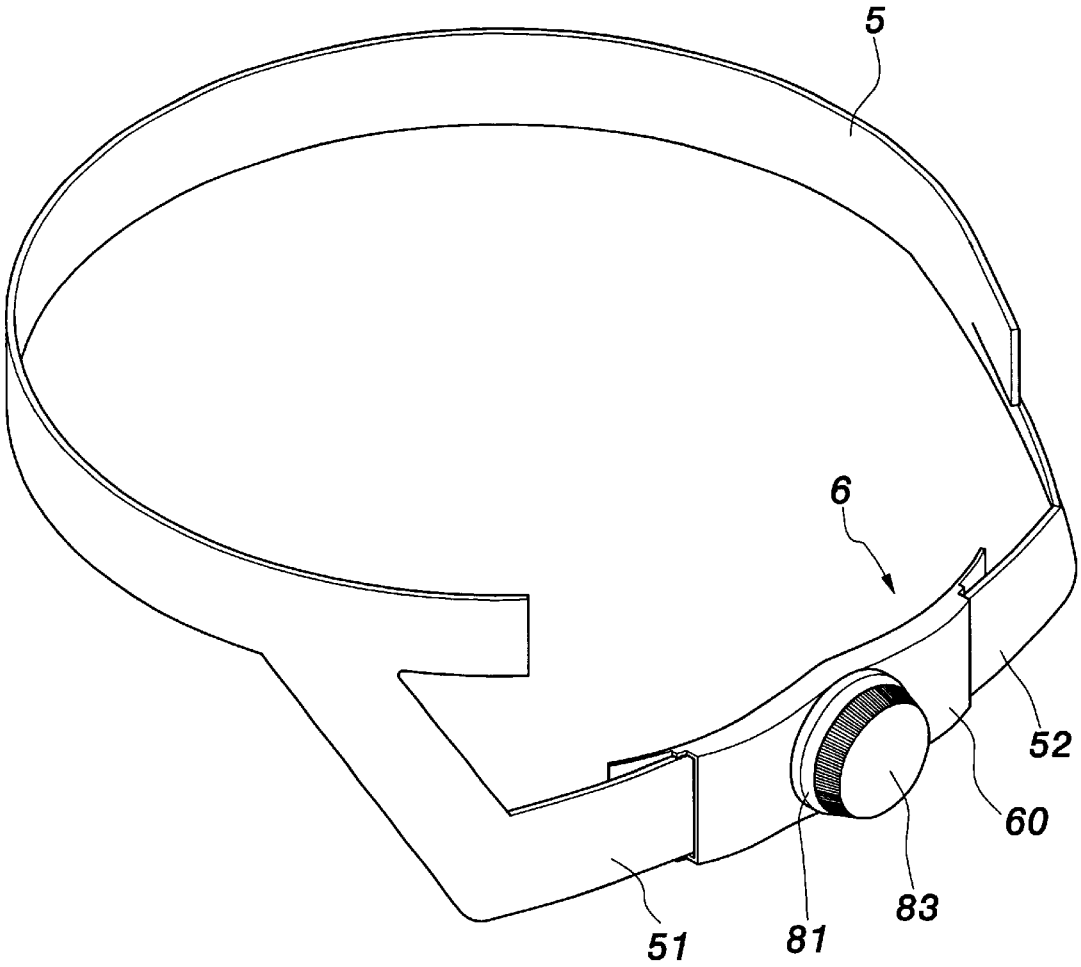
FIG. 2 is a perspective view of the present invention.
Figure 3:
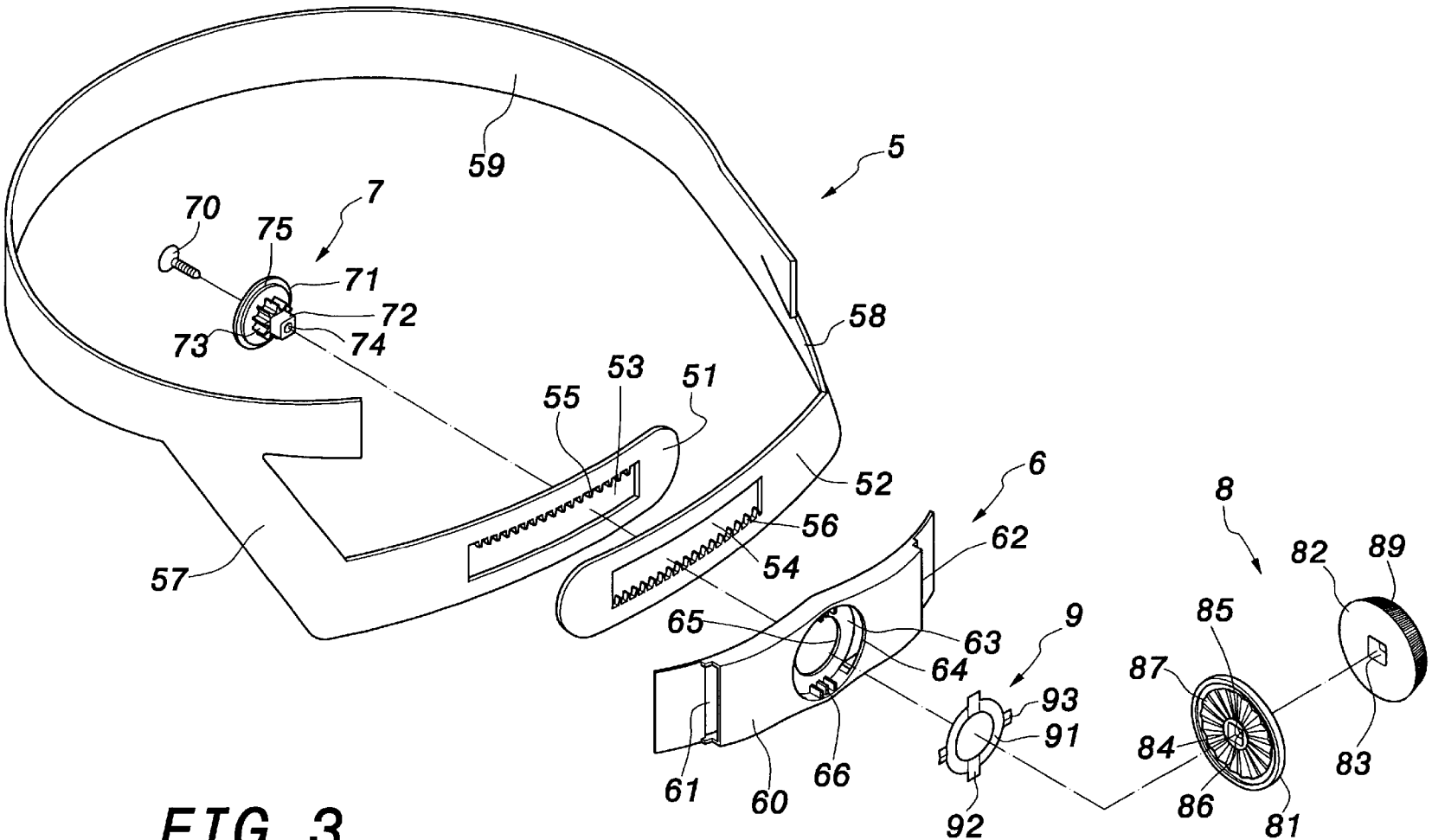
FIG. 3 is an exploded perspective view of the present invention.
Figure 4:
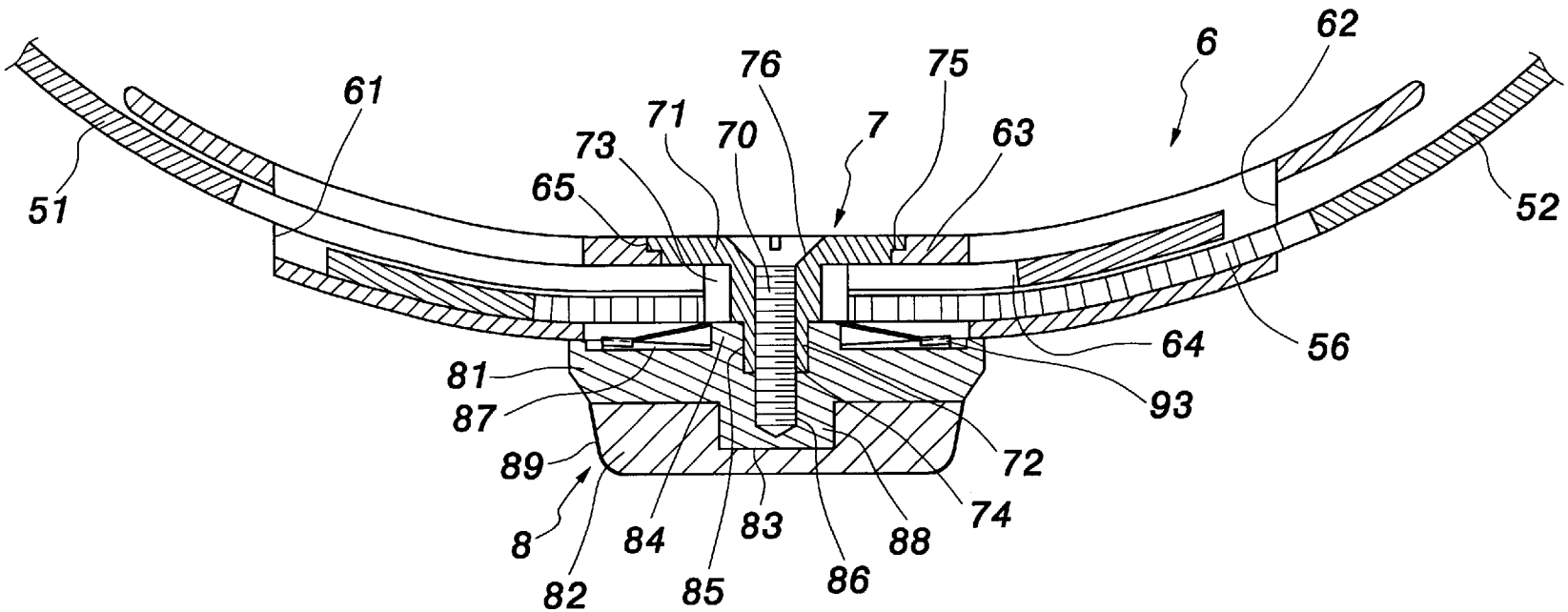
FIG. 4 is a transverse cross-sectional view of the present invention.

As shown in FIGS. 2 to 4, the present invention proposes a ring band adjustment structure of a crash helmet, which comprises a ring band 5, a connection seat 6, a guide element 7, an adjuster 8, and a locating sheet 9. Two end portions 51 and 52 of the ring band 5 have long grooves 53 and 54, respectively. An upper rack 55 is formed above the long groove 53 of the left end portion 51 of the ring band 5, and a lower rack 56 is formed below the long groove 54 of the right end portion 52 of the ring band 5. The two end portions 51 and 52 of the ring band 5 respectively use slanting extension sections 57 and 58 to join a main body section 59.

The connection seat 6 has openings 61 and 62 on two side faces thereof, respectively. The two end portions 51 and 52 are inserted into the two openings 61 and 62 on the two end faces of the connection seat 6. The connection seat 6 has a ring sheet 63 at the center of a back face thereof. An inner edge of the ring sheet 63 is a stepped inner edge 65. The guide element 7 is inserted into the connection seat 6 from a back face thereof.

A stepped outer edge 75 of a disk-shaped portion 71 of the guide element 7 is located at the stepped inner edge 65. A projective square shaft 72 of the guide element 7 penetrates through the pair of long grooves 53 and 54 of the ring band 5. A tooth portion 73 at a middle section of the guide element 7 is used to join teeth of the upper rack 55 and the lower rack 56 in the long grooves 53 and 54. A fixing element 70 passes a through hole 74 in the guide element 7 to join the adjuster 8. The fixing element 70 shown in the figures is a sunk screw, so one end portion of the through hole 70 is a fish-eye pit 76. The fixing element 70 is screwed into a screw hole 86 on a back face of the adjuster 8.

Figure 5:
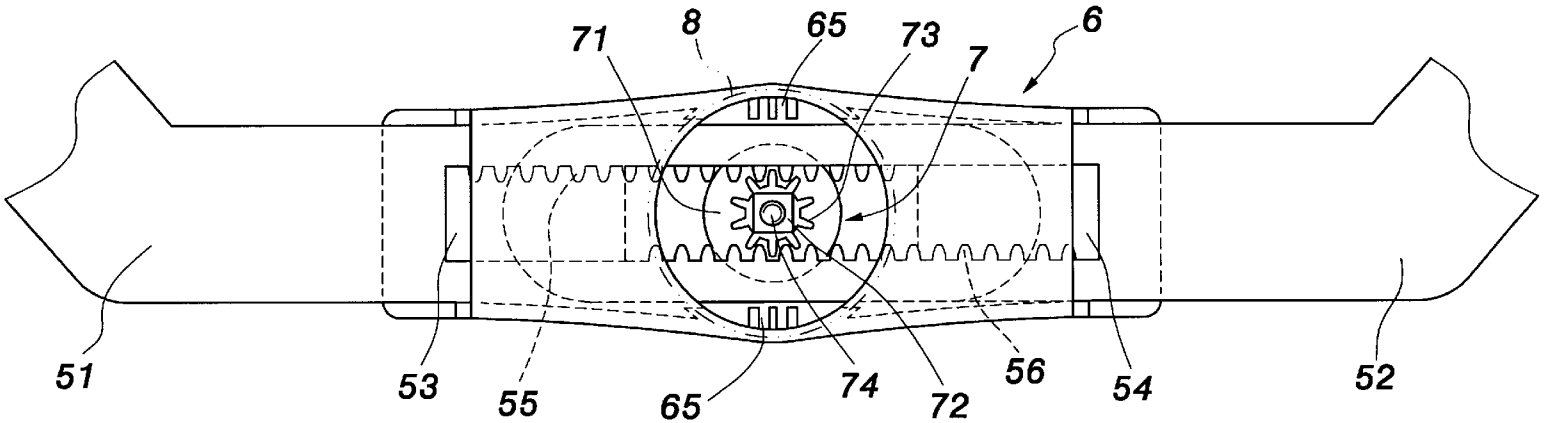
FIG. 5 is a front view of the present invention before adjustment.
Figure 6:
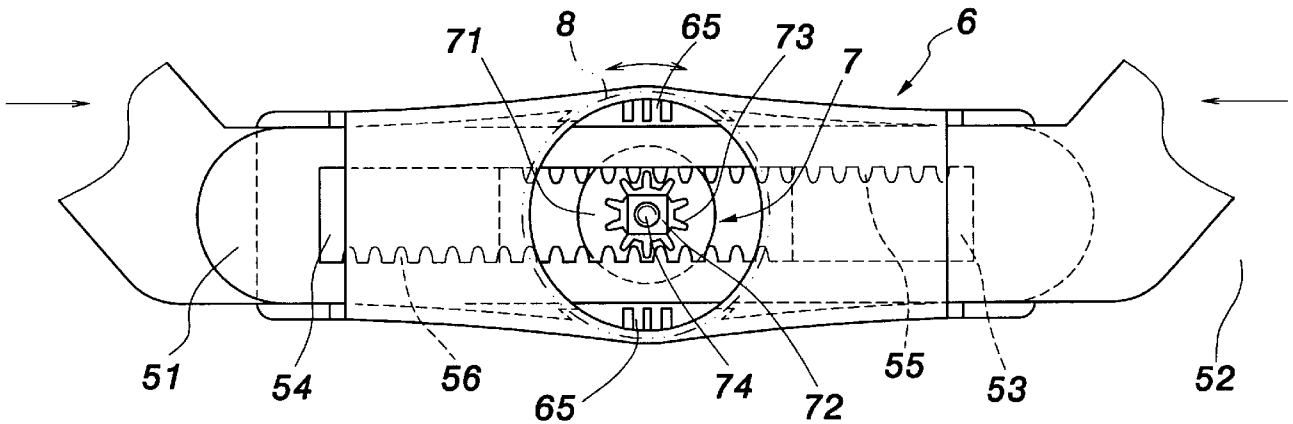
FIG. 6 is a front view of the present invention after adjustment.

The adjuster 8 also has a bump 84 on the back face thereof to penetrate into a circular groove 64 on a front face of the connection seat 6. The bump 84 has a square hole 85 therein to be inserted by the square shaft 72 of the guide element 7 so that the adjuster 8 and the guide element 7 can be joined and located. The main body of the adjuster 8 is a disk-shaped ring 81 slightly larger than the circular groove 64 to cover it. The disk-shaped ring 81 has a projective shaft 88 to join an axial hole 83 of an outer cover 82. Anti-slide veins 89 are formed on of the periphery of the outer cover 82 to facilitate grip by fingers. The tooth portion 73 of the guide element 7 can be directly driven by the adjuster 8 so that the upper rack 55 and the lower rack 56 inserted into the two end portions 51 and 52 of the ring band 5 can move toward or away from each other. Only relative displacement of the two end portions 51 and 52 of the ring band 5 in the connection seat 6 is shown in FIGS. 5 and 6 with the adjuster 8 taken away.

A locating sheet 9 is sandwiched between the adjuster 8 and the guide element 7. Cone teeth 87 are radially arranged on a back face of the adjuster 8. The connection seat 6 has locating grooves 66 at two sides thereof. The locating sheet 9 has a ring 91, which has tabs 92 respectively at an upper end portion and a lower end portion thereof to be embedded in the locating grooves 66 for locating. The ring 91 has V-shaped tabs 93 respectively at a left end and a right end thereof. The V-shaped tabs 93 are radially arranged to correspond to the cone teeth 87 to let the locating sheet 9 become a stationary structure.

The cone teeth 87 can stick with surfaces of the V-shaped tabs 93 to turn. That is, the V-shaped tabs 93 can be used to locate the adjuster 8 so that the adjuster 8 can only turn one tooth of the cone teeth 87 once. Of course, multiple teeth can be continually turned. Most importantly, through the locating of the cone teeth 87 and the V-shaped tabs 93, the adjuster 8 will not move because of the restriction of the locating sheet 9 when not turned.

Figures 8, 9:
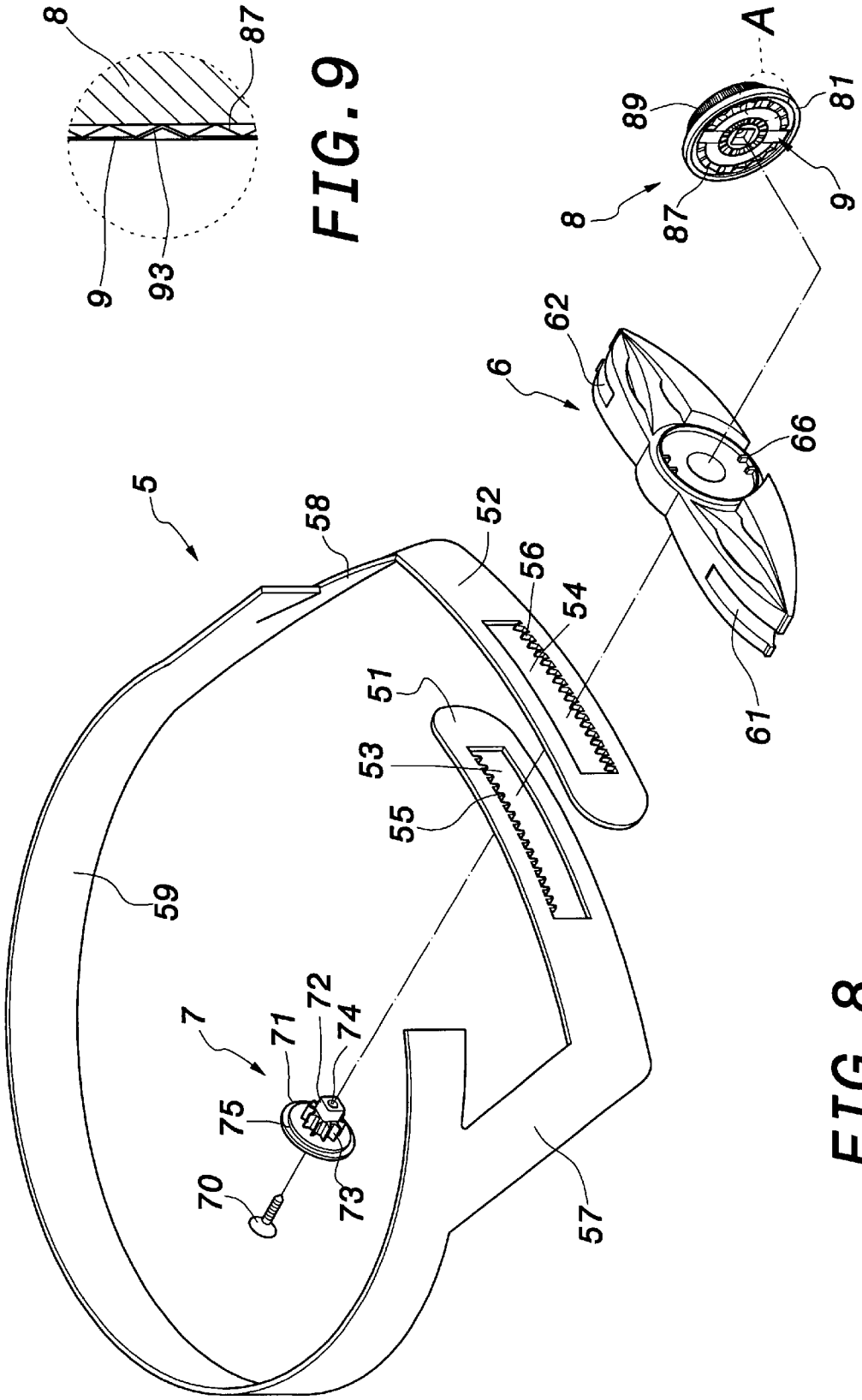
FIG. 8 is an exploded perspective view according to another embodiment of the present invention.
FIG. 9 is a side cross-sectional view showing only an outer edge of a disk-shaped ring of the A part shown in FIG. 8.

The state of the adjuster 8 and the locating sheet 9 shown in FIG. 9 is the utmost feature of the present invention. The locating sheet 9 having resiliency is used to achieve locating effect. As shown in FIGS. 4 and 8, the locating sheet 9 uses the two tabs 92 at the upper and lower end portions thereof as a central line. The ring 91 projects upwards from two sides of the central line to form resilient sheets for locking and pressing the cone teeth 87 on the back face of the adjuster 8. Thereby, the adjuster 8 will be fastened by the V-shaped tabs 93 when not used. When the adjuster 8 is exerted by a force larger than the retaining force of the V-shaped tabs 93, the adjuster 8 can be turned freely.

Figure 7:
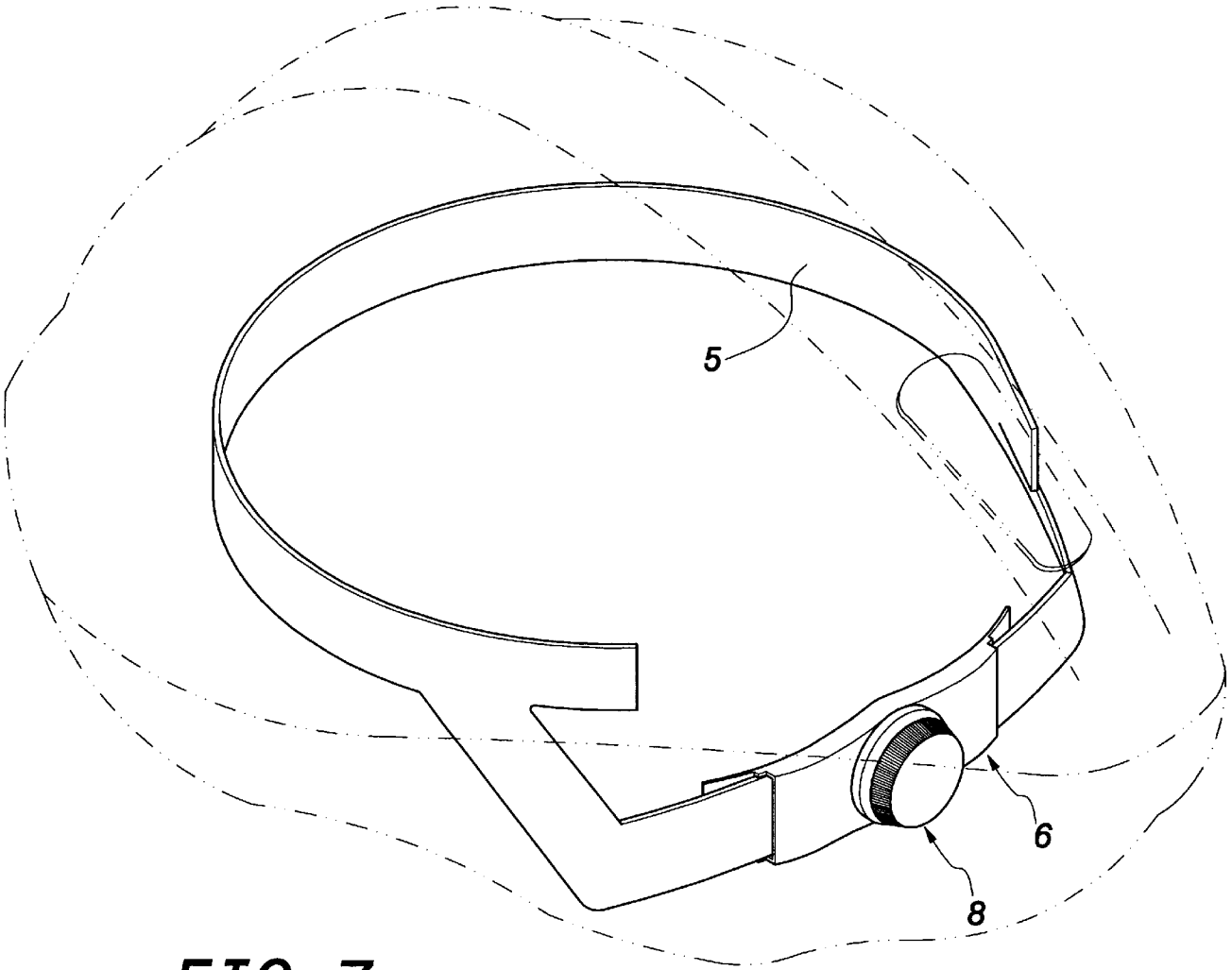
FIG. 7 is a perspective view according to an embodiment of the present invention.

To sum up, the present invention exploits matched relationship between an adjuster and a guide element to let a ring band move retractably. As shown in FIG. 7, when used in a crash helmet, the diameter of the ring band can be adjusted. The structure is simple and the manufacture and assembly is easy, thus reducing the production cost. FIG. 8 shows another form of a connection seat 6 of the present invention. The bar shape is replaced with an eye shape to display a different look. The mechanism therein is all the same. The present invention uses a rotatable adjuster to achieve joining at different positions with a tooth portion of a ring band. The locating can be accomplished by turning once, which is much more convenient than unidirectional control of the prior art. Moreover, the gripped adjuster is larger to facilitate use. Therefore, better use can be achieved by the present invention.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A ring band adjustment structure of a crash helmet, comprising:

a ring band having long grooves respectively at two end portions thereof, a dentation being formed above one said long groove of one said end portion, and a dentation being formed below the other said long groove of the other said end portion;

a connection seat having openings respectively on two side faces thereof to be inserted by said two end portions of said ring band, said connection seat having a ring sheet on a back face thereof, a stepped inner edge being formed at an inner edge of said ring sheet, said connection seat having a circular groove on a front face thereof, said connection seat having a pair of locating grooves at an upper side and a lower side thereof;

a guide element inserted into said ring sheet of said connection seat to penetrate through said two long grooves, said guide element having a tooth portion therein to join said dentations in said two long grooves, said guide element having, a stepped outer edge to be located at said stepped inner edge; an adjuster fixedly joined with said guide element, said guide element being driven to turn by said adjuster to let said inserted end portions of said ring band move toward or away from each other, said adjuster having radially arranged con e teeth on an inner face thereof; and a locating sheet having a ring, said ring having tabs respectively at an upper end portion and a lower end portion thereof said tabs being embedded in said locating grooves, said ring having V-shaped tabs respectively at a left end portion and a right end portion thereof, said V-shaped tabs being radially arranged to correspond to said cone teeth, said ring projecting upwards from two sides with said tabs at the upper and lower end portions as axis, said V-shaped tabs being used to locate said cone teeth of said adjuster to let said adjuster be stationary when not used.

2. The ring band adjustment structure of a crash helmet as claimed in claim 1, wherein the front face of said connection seat forms an eye shape.

3. The ring band adjustment structure of a crash helmet as claimed in claim 1, wherein said guide element uses a square shaft at an end portion thereof to fixedly join a square hole of said adjuster.

4. The ring band adjustment structure of a crash helmet as claimed in claim 1, wherein said guide element and said adjuster are joined together by a fixing element between them.

* * * * *